US007469961B2

(12) United States Patent
Liu

(10) Patent No.: US 7,469,961 B2
(45) Date of Patent: Dec. 30, 2008

(54) COLLAPSIBLE CHAIR

(75) Inventor: Ben Liu, Nanhai Foshan (CN)

(73) Assignee: Decarr Fantauzzo Enterprises, Inc., Honeoye Falls, NY (US)

( * ) Notice: Subject to any disclaimer, the term of this patent is extended or adjusted under 35 U.S.C. 154(b) by 183 days.

(21) Appl. No.: 11/354,417

(22) Filed: Feb. 15, 2006

(65) Prior Publication Data

US 2006/0108839 A1 May 25, 2006

(51) Int. Cl.
*A47C 4/00* (2006.01)

(52) U.S. Cl. ..... 297/16.1; 297/46; 297/378.1

(58) Field of Classification Search ..... 297/19, 297/59, 158.4, 263.1, 258.1, 261.1, 259.1, 297/54, 48, 16.1, 46, 20, 52, 53, 378.1; 108/125; 248/440; 5/174
See application file for complete search history.

(56) References Cited

U.S. PATENT DOCUMENTS

| | | | | |
|---|---|---|---|---|
| 100,733 | A | 3/1870 | Crummy et al. | |
| 164,060 | A * | 6/1875 | Wakefield | 297/40 |
| 164,061 | A | 6/1875 | Ware | |
| 444,992 | A * | 1/1891 | Pohi | 297/20 |
| 2,740,465 | A * | 4/1956 | Mugler | 297/31 |
| 4,278,287 | A | 7/1981 | Homestead | |
| 4,541,666 | A | 9/1985 | Vanderminden | |
| 4,684,170 | A * | 8/1987 | Colby | 297/19 |
| 5,282,664 | A | 2/1994 | Tseng | |
| 5,709,428 | A * | 1/1998 | Hugghins | 297/16.2 |
| 5,931,526 | A | 8/1999 | Tseng | |
| 6,056,172 | A * | 5/2000 | Welsh | 224/155 |
| 6,254,177 | B1 | 7/2001 | Tseng | |
| 2002/0125744 | A1 * | 9/2002 | Tseng | 297/16.1 |
| 2003/0111873 | A1 | 6/2003 | Tseng | |
| 2005/0077758 | A1 | 4/2005 | Reese | |

* cited by examiner

*Primary Examiner*—David Dunn
*Assistant Examiner*—James Alex
(74) *Attorney, Agent, or Firm*—Brooks Kushman P.C.

(57) ABSTRACT

A collapsible chair is disclosed having an arcuate frame with an upward peak and a downward peak for seating of a user in the downward peak and resting of the user's legs upon the upward peak. The frame may have a pivotal connection between the peaks for collapsing the frame. A linkage is disclosed operably connected to the frame for providing legs to the chair in an extended position and for collapsing with the frame.

17 Claims, 5 Drawing Sheets

COLLAPSIBLE CHAIR

BACKGROUND OF THE INVENTION

1. Field of the Invention

The invention relates to chairs, more particularly the invention relates to collapsible chairs.

2. Background Art

The prior art has provided collapsible chairs for facilitating transportation of chairs for utilization in various environments. Collapsible chairs are often limited in shape and size as a drawback to permit collapsing of the chair or manual transportation of the chair.

SUMMARY OF THE INVENTION

An embodiment of the present invention provides a collapsible chair with an arcuate frame having an upward peak and a downward peak for seating of a user in a downward peak and resting of the user's legs upon the upward peak. The frame has a pivotal connection between the peaks for collapsing the frame. A linkage is connected to the frame for providing legs to the chair in an extended position of the chair, and for collapsing with the frame.

Another embodiment of the present invention provides a collapsible chair with a first arcuate frame pivotally connected to the second arcuate frame for extending to a seating position wherein the first frame arches outward and the second frame arches inward. The first and second arcuate frames collapse to a position wherein the first and second frames are displaced adjacent one another. A linkage is operably connected to the first and second frames for collapsing and extending with the frames and for providing a structural support to the chair for resting upon an underlying support surface in the extended position of the chair.

The above embodiments, objects, features, and advantages of the present invention are readily apparent from the following detailed description of the invention when taken in connection with the accompanying drawings.

DETAILED DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
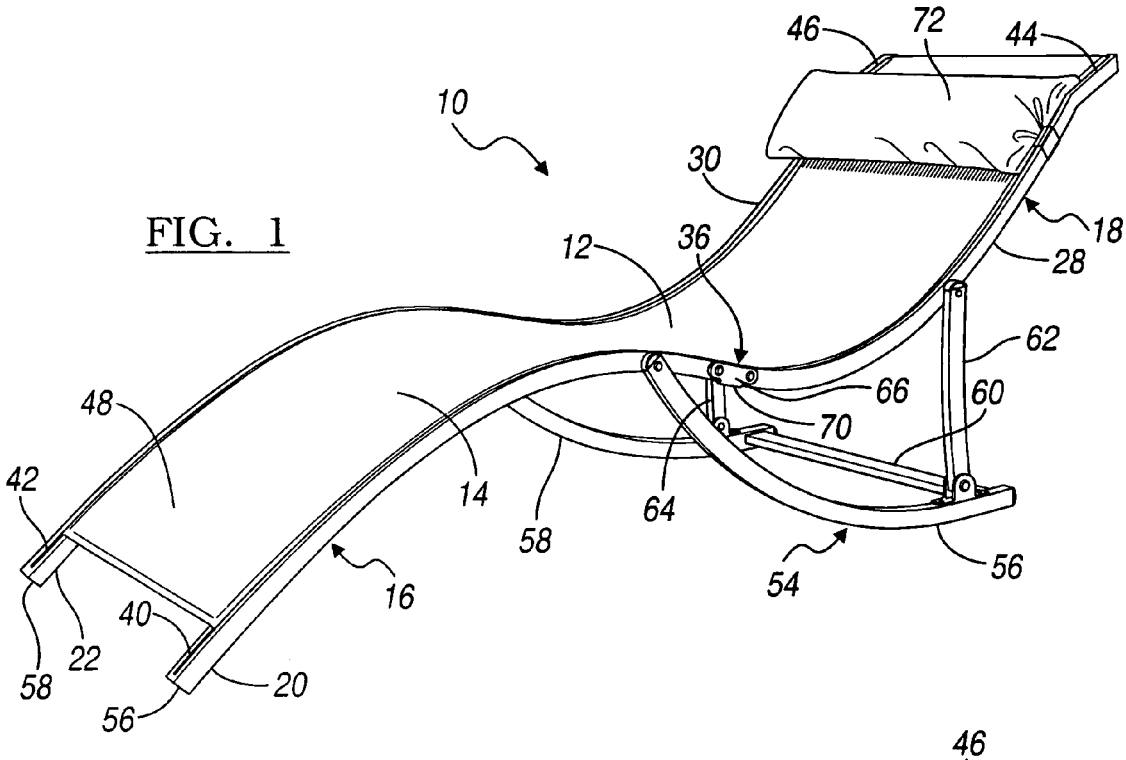
FIG. 1 is a perspective view of a collapsible chair in accordance with the present invention.
Figure 2:
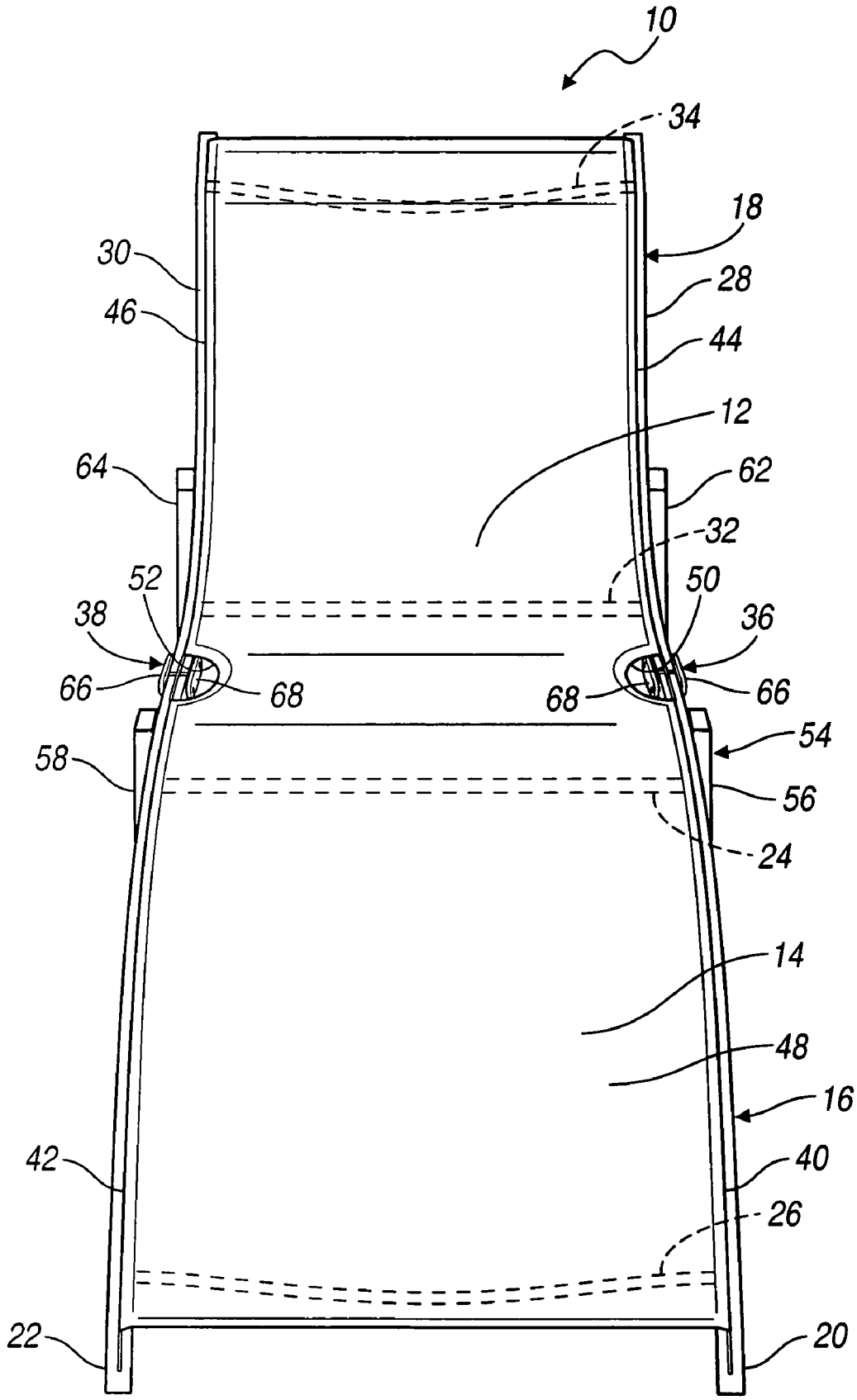
FIG. 2 is a front perspective view of the collapsible chair of FIG. 1.

With reference now to FIGS. 1 and 2, an embodiment of a collapsible chair is illustrated in accordance with the present invention, and is referenced generally by numeral 10. The chair 10 provides both seating and lounging of a user, by incorporating a seat support region with a seat back and seat bottom, and a leg support region. Such chairs are often referred to as loungers and chaises. The chair 10 has a longitudinal length with a downward peak 12 for seating a user thereon, and an upward peak 14 for rest of the user's legs thereon.

The collapsible chair 10 is contoured to ergonomically support the user by providing a contour that is sized to match the shape of the user's body when oriented in a lounging or resting position. The peaks 12, 14 provide non-planar resting surfaces for engaging the user along the contour instead of providing a planar contact surface, as in the prior art.

The chair 10 includes a first frame half 16 and a second frame half 18. The frame halves 16, 18 are both arcuate along their lengths for providing the peaks 12, 14 when the frame halves 16, 18 are oriented in an extended or seating position. The frame halves 16, 18 are similarly profiled for being generally compact when collapsed.

The first frame half 16 includes a pair of arcuate rails 20, 22 that are spaced laterally by a pair of cross-members 24, 26. Likewise, the second frame half 18 includes a pair of arcuate rails 28, 30 which are also spaced laterally by a pair of cross-members 32, 34.

The first frame half 16 and the second frame half 18 have coterminous proximal ends meeting between the downward peak 12 and the upward peak 14. The connection of the first frame half 16 and the second frame half 18 may be a pivotal connection. A pair of intermediate links 36, 38 are provided to permit a full rotation of one hundred-eighty degrees of the frame halves 16, 18 relative to another. The intermediate links 36, 38 each have a pivotal connection with the first frame half 16 and another pivotal connection of the second frame half 18 that is spaced apart from the pivotal connection with the first frame half 16.

The rails 20, 22, 28, 30 of the frame halves 16, 18 include lengthwise slots 40, 42, 44, 46 formed therein. A fabric 48 extends through the slots 40, 42, 44, 46 of the rails 20, 22, 28, 30 for providing a flexible and comfortable seating surface for the user. The fabric 48 includes a pair of cutouts 50, 52 for providing clearance for the intermediate links 36, 38. The fabric 48 can be formed from various fabrics in accordance with the present invention. The fabric 48 may be formed of a mesh fabric that is breathable for permitting air to pass through for user comfort and cooling by ambient air. Additionally, the fabric 48 may be weather resistant, ultra-violet protected, and mold resistant for withstanding conditions of external environments.

The collapsible chair 10 also includes a linkage 54 mounted to the first and second frame halves 16, 18 for collapsing and extending with the frame halves 16, 18 and for providing structural support for the chair 10. In the extended or seating position of the chair 10, the linkage 54 provides legs for the chair 10, which engage an underlying support surface such as the ground so that the chair may rest thereupon. Additionally, distal ends 56, 58 of rails 20, 22 of the first frame half 16 also engage the underlying support surface for providing legs to the chair 10.

The linkage 54 includes a pair of base links 56, 58 which are each pivotally connected to an outboard lateral side of the rails 20, 22 of the first frame half 16. A cross-member 60 is mounted to the base links 56, 58 for providing lateral support to the base links 56, 58 and for coordinating translation of the base links 56, 58. A pair of support links 62, 64 are also provided in the linkage 54. The support links 62, 64 are each pivotally connected to a corresponding base link 56, 58 and a corresponding rail 28, 30 of the second frame half 18. The support links 62, 64 are pivotally connected to the corresponding rails 28, 30 at an outboard lateral side of the rails 28, 30.

Figure 3:
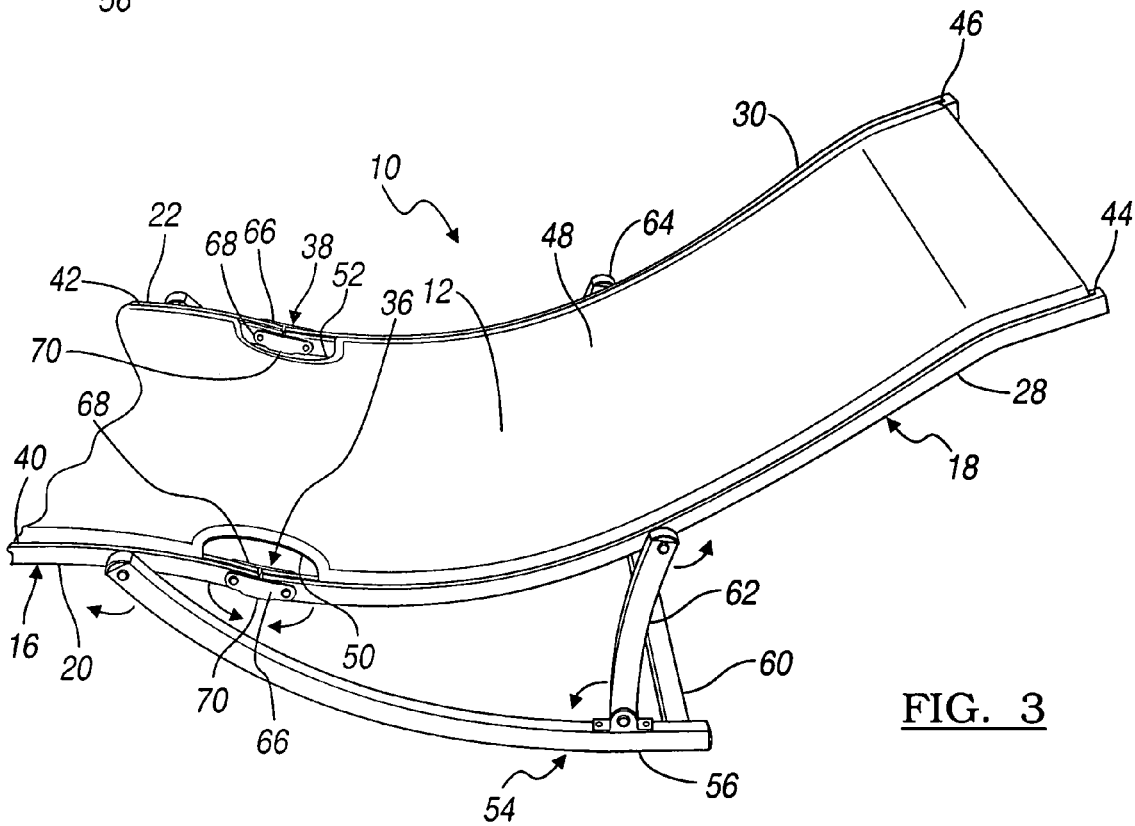
FIG. 3 is a side perspective view of a portion of the collapsible chair of FIG. 1.

The linkage 54 and the frame halves 16, 18 collectively collapse and expand together. With reference now to FIG. 3, the chair 10 is illustrated in the extended or seating position. The intermediate links 36, 38 each include an outboard plate 66, and an inboard plate 68, which are interconnected by a connecting plate 70 that is displaced beneath the coterminous ends of the frame halves 16, 18. The connecting plate 70 acts as a hard stop for preventing the frame halves 16, 18 from folding closed when a user rests thereupon. Thus, the frame halves 16, 18 can only be collapsed in one direction. These direction is indicated by the arcuate arrows at the intermediate link 36 in FIG. 3. Thus, the collapsible chair 10 provides a sturdy seating position collectively to the frame halves 16, 18 and the linkage 54. Further support is provided by the linkage 54 with the base links 56, 58 extending to the ground and the support links 62, 64 which provide upright support to the second frame half 18.

As the chair 10 is collapsed from the seating orientation of FIGS. 1 and 2, the first frame half 16 and the second frame half 18 are converged by pivoting about the intermediate links 36, 38 in the direction of the arcuate arrows illustrated in FIG. 3. Additionally, as the collapsible chair 10 collapses, the base links 56, 58 pivot towards the rails 20, 22 of the first frame half 16, as depicted by the arcuate arrow at the pivotal connection of the base link 56 and the rail 20 in FIG. 3. Likewise, the support links 62, 64 pivot towards the rails 28, 30 of the second frame half 18 while collapsing. The arcuate arrow illustrated in FIG. 3 proximate to the pivotal connection of the support link 62 and the rail 28 of the second frame half 18 indicates the rotational translation of the support links 62, 64 relative to the second frame half 18 as the chair 10 is collapsed. As the collapsible chair 10 collapses, the base links 56, 58 and the support links 62, 64 converge at an included angle therebetween as illustrated by the arcuate arrow in FIG. 3 depicting the rotational translation of the support links 62, 64 relative to the base links 56, 58.

Figure 4:
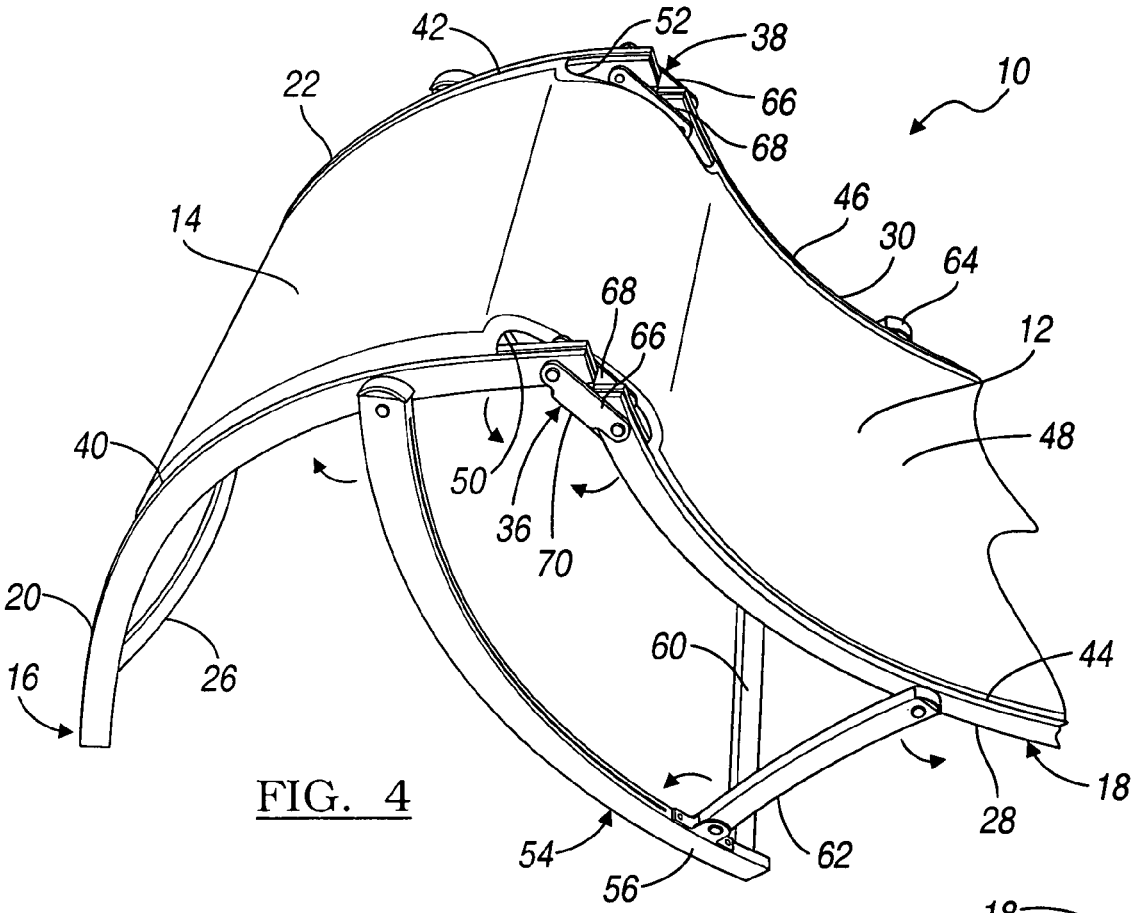
FIG. 4 is a side perspective view of the collapsible chair of FIG. 1, illustrated in a partially collapsed orientation.

With reference now to FIG. 4, the collapsible chair 10 is illustrated partially collapsed depicting the first frame half 16 and the second frame half 18 converging towards one another. Likewise, the base links 56, 58 are illustrated translating towards the rails 20, 22 of the first frame half 16. The support links 62, 64 are illustrated pivoting towards the rails 28, 30 of the second frame half 18. Additionally, the base links 56, 58 and support links 62, 64 are illustrated converging.

Figure 5:
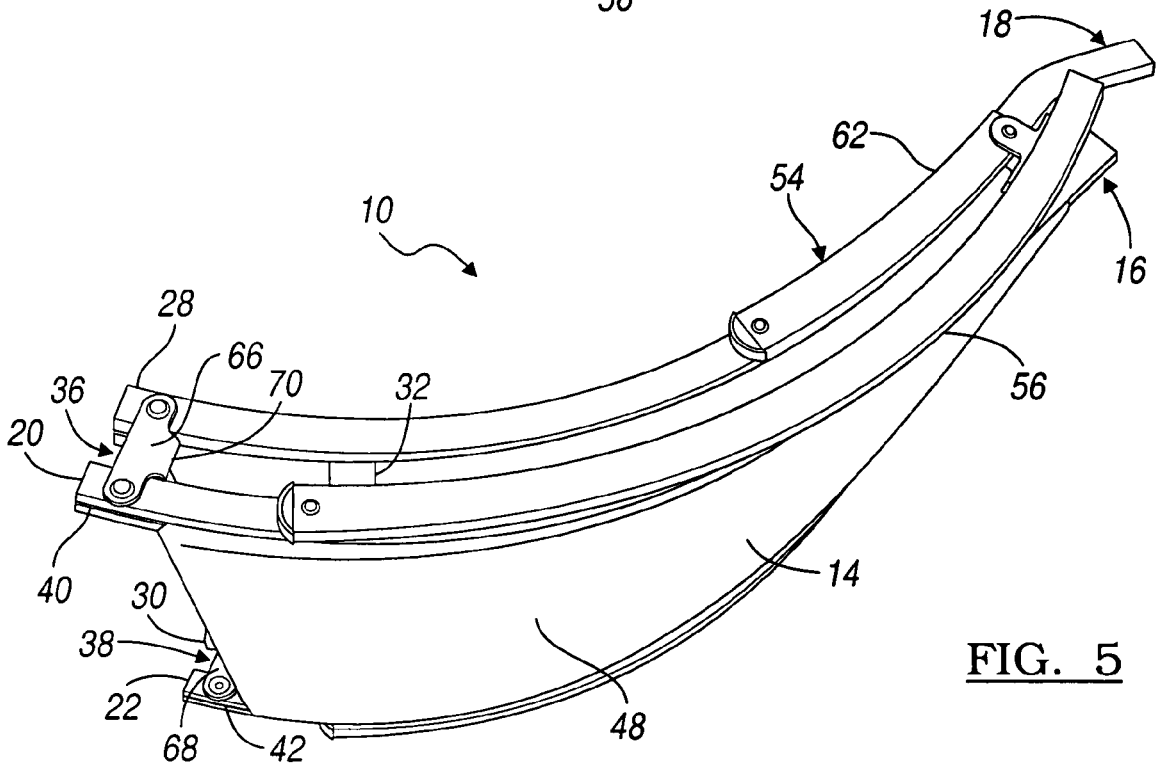
FIG. 5 is a side perspective view of the collapsible chair of FIG. 1, illustrated in a collapsed orientation.

With reference now to FIG. 5, the collapsible chair 10 is illustrated in a collapsed position. The first frame half 16 and the second frame half 18 are stacked upon each other with the matching arcuate contours obtaining a compact orientation relative to another. The base links 56, 58 and the support links 62, 64 are displaced adjacent to the rails 20, 22, 28, 30 of the first and second frame halves 16, 18 for also providing a compact, collapsed position. The base links 56, 58 and the support links 62, 64 each have arcuate contours similar to the overall arcuate contour of the first and second frame halves 16, 18 for generally aligning adjacent to the first and second frame halves 16, 18 in the collapsed orientation, thereby minimizing an overall thickness of the collapsed chair 10.

In order to expand the collapsible chair 10, the first and second frame halves 16, 18 are pivoted away from one another and expanded in the orientation illustrated in FIG. 4. Likewise, the base links 56, 58 and the support links 62, 64 are deployed within an included angle of the first and second frame halves 16, 18 as illustrated in FIG. 4. As the collapsible chair 10 is further expanded, the first and second frame halves 16, 18 obtain a maximum pivot orientation as illustrated in FIG. 3 and are limited by the hard stop of the connecting plate 70 of the intermediate links 36, 38. At this orientation, the base link 56, 58 and the support links 62, 64 of the linkage 54 are fully deployed for supporting the collapsible chair 10.

Referring again to FIG. 1, the collapsible chair 10 may include a pillow 72 mounted to the second frame half 18 for resting the user's head thereon. Since the pillow 72 is displaced along an exterior seating surface of the fabric 48, the pillow 72 does not interfere with the collapsing of the chair 10. The invention contemplates that the pillow 72 may be detachable and may be stowed separately from the chair 10.

The rails 20, 22, 28, 30 of the first and second frame halves 16, 18 and the associated cross-members 24, 26, 32, 34, as well as the base links 56, 58, base link cross-member 60 and support links 62, 64 of the linkage 54 may all be formed of any suitable material that is sufficient to structurally support the user upon the fabric 48 of the collapsible chair 10. The invention contemplates that the components of the chair 10 may all be formed of extruded aluminum or an extruded aluminum alloy. Aluminum and aluminum alloys are generally rust proof for resisting conditions that may be provided in associated environments. For example, the collapsible chair illustrated in FIG. 1, may be formed of extruded aluminum and fabric and may have a weight that is less than or equal to ten pounds. More specifically, the chair 10 illustrated in FIG. 1 may have a weight of seven pounds or less. At a weight of seven pounds or less, the collapsible chair 10 has a load capacity of at least three hundred pounds for supporting users having a weight of up to three hundred pounds.

Figure 6:
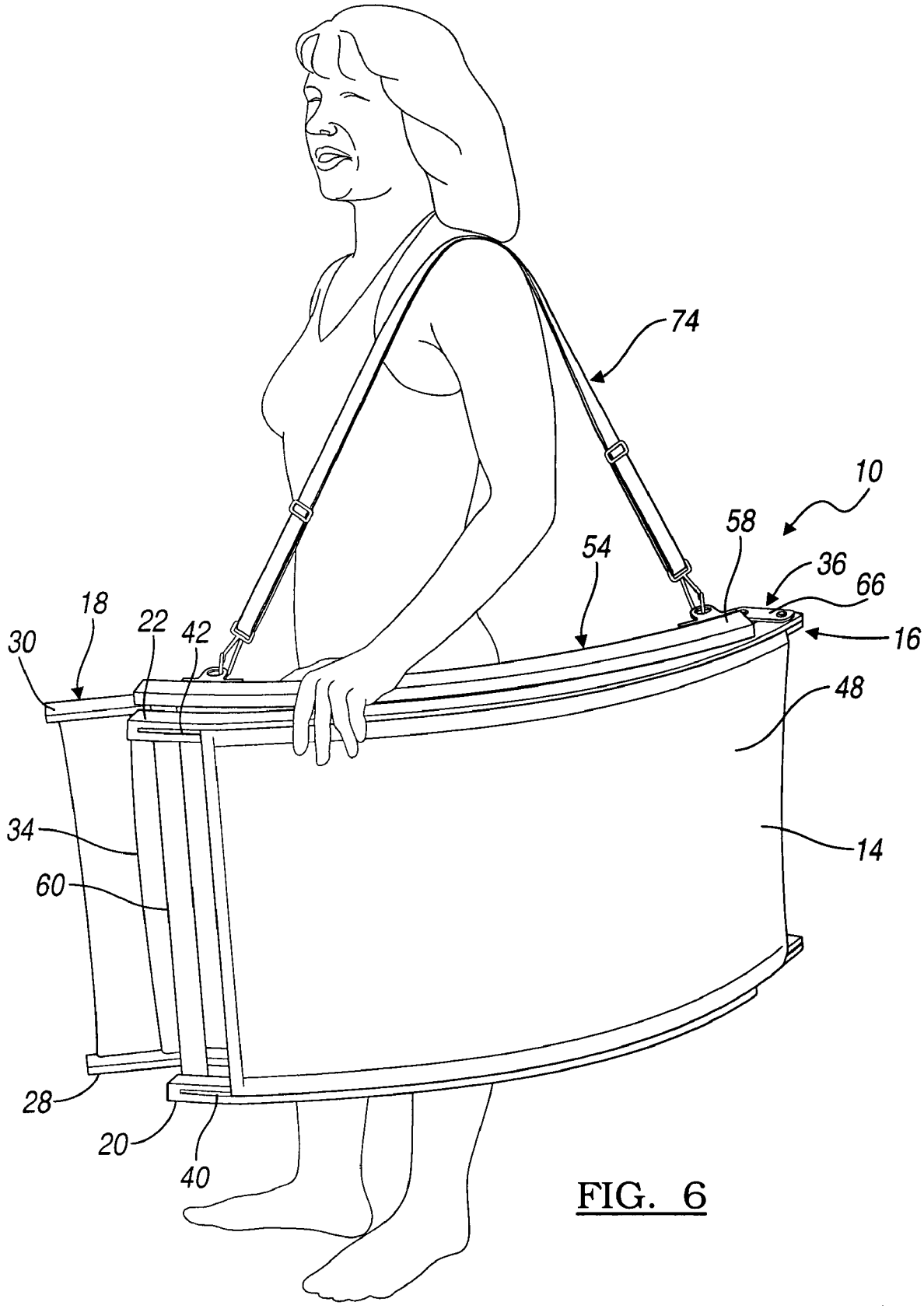
FIG. 6 is a side perspective view of the collapsible chair of FIG. 1, illustrated in the collapsed position of FIG. 5, in cooperation with a strap and being transported by a user.

Due to the compactness of the collapsed position of the collapsible chair 10, the collapsible chair 10 may be easily transported and thereby utilized at various environments such as beaches, boating environments, patios, campgrounds, yards, sporting activities and the like. Referring now to FIG. 6, the collapsible chair 10 may include a strap 74, which may be worn over a shoulder of the user for ease in transportation of the collapsible chair 10.

Figure 7:
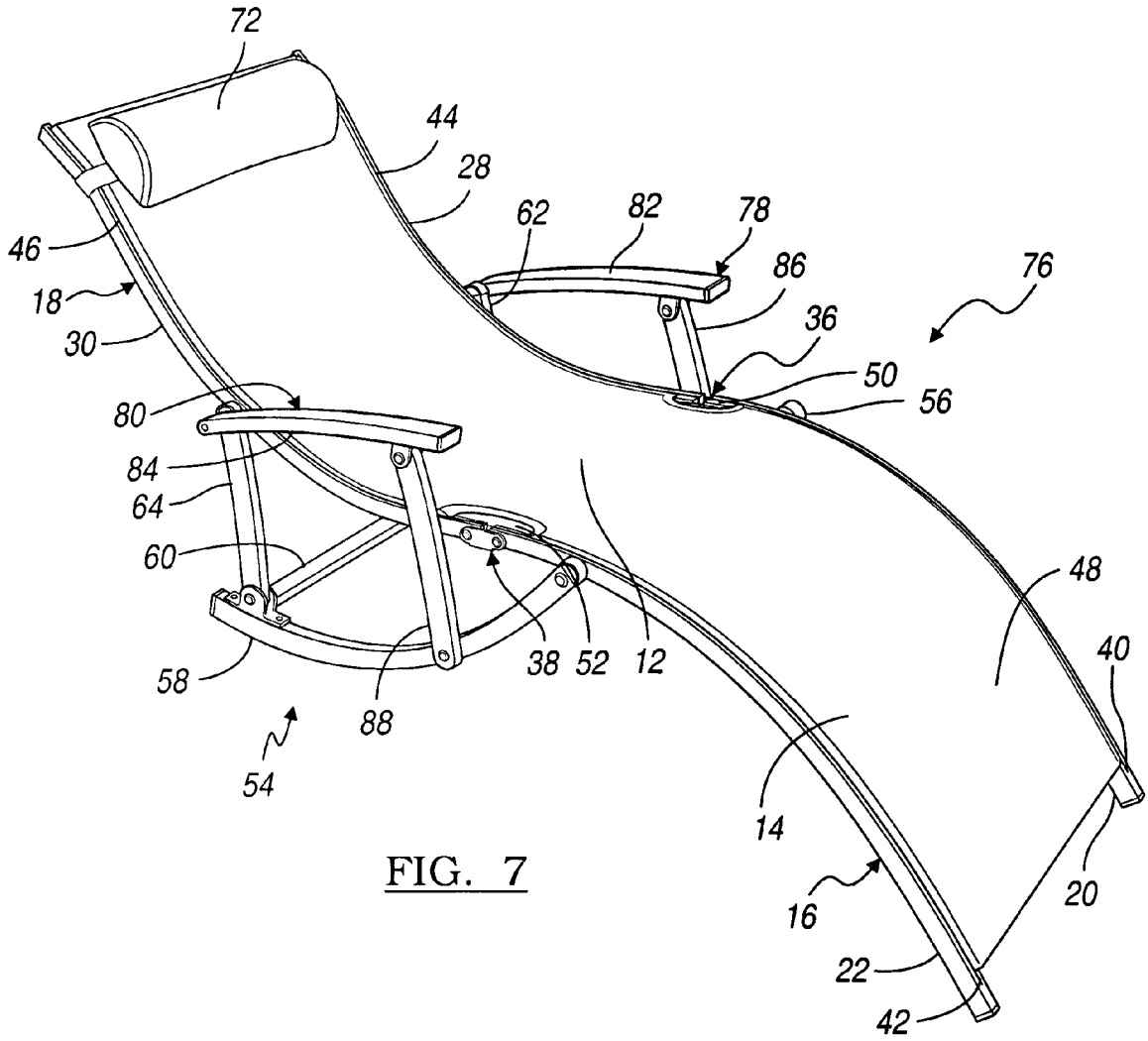
FIG. 7 is a perspective view of another collapsible chair in accordance with the present invention.

In FIG. 7, another collapsible chair embodiment is illustrated in accordance with the present invention and is referenced generally by numeral 76. The collapsible chair 76 may include many of the same components of the collapsible chair 10 of prior embodiments. Therefore, like elements are depicted by same reference numerals, wherein new elements are assigned new reference numerals.

The collapsible chair 76 includes a pair of armrests 78, 80 extending from opposed lateral sides of the chair 76. Each armrest 78, 80 is pivotally connected to the linkage 54 for collapsing in a compact manner with the linkage 54 and the chair 76, and for extending to a position for supporting the user's arms in the seating position of the chair 76.

Each armrest 78, 80 may be provided with an armrest member 82, 84 pivotally connected to a corresponding support link 62, 64 of the linkage 54. The armrest members 82, 84 extend forward from the support links 62, 64 in the seating position for receiving the user's arms. Each armrest 78, 80 may also include an armrest support link 86, 88 for supporting the armrest members 82, 84 in the seating position and for coordinating extension and collapsing of the armrests 78, 80 with the chair 76. The armrest support links 86, 88 are each pivotally connected to a forward region of the associated armrest member 82, 84. The armrest support links 86, 88 are also pivotally connected to an intermediate region of the associated base link 56, 58.

The armrest members 82,84 and the armrest support links 86, 88 of the armrests 78, 80 define four bar link mechanisms with the base links 56, 58 and the support links 62, 64. The four bar link mechanisms facilitate the translation of the armrests 78, 80 to and from the extended and collapsed positions. Thus, the armrests 78, 80 enhance user comfort without detracting from the portability and compactness of the collapsible chair. Additionally the armrest members 82, 84 and the armrest support links 86, 88 may be formed from a similar material as the other components of the collapsible chair 76, such as an extruded aluminum alloy for providing adequate support to the user, without adding significant weight to the chair 76.

The extended positions of the armrests 78, 80 are depicted in FIG. 7. As the base links 56, 58 and the support links 62, 64 converge during collapsing of the chair 76, the armrest members 82, 84 and the armrest support links 86, 88 converge as well. In the collapsed position of the chair 76, the armrest members 82, 84 are displaced alongside the second frame half 18 adjacent to the arcuate rails 28, 30. Likewise, the armrest support links 86, 88 are displaced alongside the first frame half 16, adjacent to the base links 56, 58 in the collapsed position of the chair.

Although the armrests 78, 80 are illustrated and described in detail for the embodiment depicted in FIG. 7, the invention contemplates various armrest embodiments in combination with various collapsible chair 76.

In summary, collapsible chairs are disclosed that each provide an arcuate seating surface that is contoured to match the body of a user with a linkage for supporting the chair, which may be collectively collapsed into a compact orientation by one movement of the chair frame. The collapsible chairs are light in weight, and sturdy for sufficient seating use and transportation.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A collapsible lounge chair comprising:

a first frame having an arcuate contour along its length, the first frame having a proximal end and a distal second end spaced apart from the proximal end with the arcuate contour therebetween;

a second frame having an arcuate contour along its length, the second frame having a proximal end and a distal second end spaced apart from the proximal end with the arcuate contour therebetween, the proximal end of the second frame being pivotally connected to the proximal end of the first frame for extending to a seating position wherein the second end of the first frame is spaced apart from the second end of the second frame and the first frame arches outward providing a leg support region and the second frame arches inward providing a back support region, and the first frame and the second frame collectively provide a seat support region, and for collapsing to a collapsed position wherein the second end of the first frame is adjacent to the second end of the second frame and the first frame and the second frame are stacked relative to another such that the arcuate contour of the first frame is parallel to, aligned with, and offset from the arcuate contour of the second frame and the leg support region is spaced apart from and facing the back support region, thereby collectively providing an arcuate collapsed profile; and a linkage operably connected to the first frame and the second frame for collapsing and extending with the first and second frames and for providing a structural support to the chair for resting upon an underlying support surface in the extended position of the chairs;

wherein the leg support region, the seat support region and the back support region are aligned with the arcuate contour of the corresponding frame;

wherein the distal end of the first frame engages the underlying support surface in the extended position of the chair and the linkage is extended substantially beneath the second frame in the extended position of the chair to support the second frame above the underlying support surface so that the back support region is oriented inclined from the seat support region and the leg support region extends lower than the seat support region; and wherein the linkage is displaced adjacent to and aligned with the first and second frames in the collapsed position without substantially exceeding the arcuate collapsed profile.

2. The collapsible lounge chair of claim 1 further comprising a fabric material secured to the first and second frames for supporting a user thereon.

3. The collapsible lounge chair of claim 1 wherein the first frame further comprises a pair of spaced apart arcuate members interconnected with at least one cross-member.

4. The collapsible lounge chair of claim 1 further comprising a pillow for receiving a head of a user.

5. The collapsible lounge chair of claim 1 further comprising a strap for facilitating transportation of the chair.

6. The collapsible lounge chair of claim 1 wherein the first and second frames are formed from extruded aluminum.

7. The collapsible lounge chair of claim 1 wherein the chair has a weight of less than or equal to ten pounds.

8. The collapsible lounge chair of claim 1 wherein the chair has a weight of less than seven pounds.

9. The collapsible lounge chair of claim 1 wherein the chair has a load capacity of at least three hundred pounds.

10. The collapsible lounge chair of claim 1 wherein the second frame further comprises a pair of spaced apart arcuate members interconnected with at least one cross-member.

11. The collapsible lounge chair of claim 1 further comprising an intermediate link pivotally connected to the first frame and second frame for interconnecting the first and second frames and for permitting translation of the first and second frames to at least one half of a turn.

12. The collapsible lounge chair of claim 1 further comprising a pair of armrests each operably connected to the linkage for collapsing with the first and second frame halves, and for extending in an orientation adjacent to lateral sides of the second frame for supporting arms of a user in the seating position.

13. The collapsible lounge chair of claim 1 wherein the linkage further comprises:

a base link pivotally connected to the first frame, the base link extending from the first frame in the extended position for resting upon the underlying support surface; and a support link pivotally connected to the second frame and the base link for supporting the second frame in the extended position and for coordinating translation of the links and frames to the collapsed position.

14. The collapsible lounge chair of claim 13 wherein the base link and the support link each have an arcuate contour along its length corresponding with the arcuate contours of the first and second frames for collapsing adjacent to and aligned with the arcuate first and second frames.

15. The collapsible lounge chair of claim 13 wherein the base link further comprises a pair of base links, each displaced on opposed lateral sides of the first frame; and wherein the support link further comprises a pair of support links, each displaced on opposed lateral sides of the second frame, pivotally connected to the corresponding base link.

16. The collapsible lounge chair of claim 1 wherein the first frame has an upward peak and the second frame has a downward peak for seating of a user's torso in the downward peak and resting of the user's legs upon the upward peak, the frame having the pivotal connection at coterminous proximal frame ends between the upward peak and the downward peak for collapsing the frame such that the downward peak is stacked upon the upward peak.

17. A collapsible lounge chair comprising:

a first frame half having an arcuate contour along its length, the first frame half having a proximal end and a distal second end spaced apart from the proximal end with the arcuate contour therebetween;

a pair of laterally spaced apart intermediate links each pivotally connected to the proximal end of the first frame;

a second frame half having an arcuate contour along its length, the second frame half having a proximal end and a distal second end spaced apart from the proximal end with the arcuate contour therebetween, the proximal end of the second frame half being pivotally connected to the pair of intermediate links for extending to a seating position wherein the second end of the first frame half is spaced apart from the second end of the second frame half and the first frame half arches outward providing a leg support region and the second frame half arches inward providing a back support region, and the first frame half and the second frame half collectively provide a seat support region, and for collapsing to a collapsed position wherein the second end of the first frame half is adjacent to the second end of the second frame half and the first frame half and the second frame half are stacked relative to another such that the arcuate contour of the first frame half is parallel to, aligned with, and offset from the arcuate contour of the second frame half and the leg support region is spaced apart from and facing the back support region, thereby collectively providing an arcuate collapsed profile;

a pair of laterally spaced apart base links each pivotally connected to the first frame half, the base links extending from the first frame half in the extended position for resting upon the underlying support surface; and a pair of laterally spaced apart support links each pivotally connected to the second frame half and the corresponding base link for supporting the second frame half in the extended position and for collective collapsing of the frame halves and the intermediate, base and support links;

wherein the leg support region, the seat support region and the back support region are aligned with the arcuate contour of the corresponding frame half;

wherein the distal end of the first frame half engages the underlying support surface in the extended position of the chair, and the pair of base links and the pair of support links are extended substantially beneath the second frame half in the extended position of the chair to support the second frame half above the underlying support surface so that the back support region is oriented inclined from the seat support region and the leg support region extends lower than the seat support region; and wherein the pair of base links and the pair of support links are displaced adjacent to and aligned with the first and second frame halves in the collapsed position without substantially exceeding the arcuate collapsed profile.

* * * * *

UNITED STATES PATENT AND TRADEMARK OFFICE

CERTIFICATE OF CORRECTION

PATENT NO. : 7,469,961 B2
APPLICATION NO. : 11/354417
DATED : December 30, 2008
INVENTOR(S) : Liu It is certified that error appears in the above-identified patent and that said Letters Patent is hereby corrected as shown below:

Column 6, Line 12, Claim 1:

Delete “chairs” and insert -- chair --.

Signed and Sealed this

Twenty-fourth Day of February, 2009

JOHN DOLL
*Acting Director of the United States Patent and Trademark Office*